US005444524A

United States Patent [19]

Lee

[11] Patent Number: 5,444,524

[45] Date of Patent: Aug. 22, 1995

[54] METHOD AND APPARATUS FOR CONTROLLING A PRINT ENGINE OF A PAGE PRINTING DEVICE

[75] Inventor: Bong-Gi Lee, Hyungki-do, Rep. of Korea

[73] Assignee: SamSung Electronics Co., Ltd., Suwon, Rep. of Korea

[21] Appl. No.: 82,917

[22] Filed: Jun. 28, 1993

[30] Foreign Application Priority Data

Jun. 26, 1992 [KR] Rep. of Korea ..... 11243

[51] Int. Cl.[6] ..... G03G 21/00

[52] U.S. Cl. ..... 355/316; 271/258.04; 271/259; 355/206

[58] Field of Search ..... 355/203, 206, 208, 308, 355/309, 316, 317, 321; 271/258, 259, 265

[56] References Cited

U.S. PATENT DOCUMENTS

| | | | |
|---|---|---|---|
| 4,723,145 | 2/1988 | Takada et al. | 355/202 |
| 4,733,281 | 3/1988 | Yoshinaga et al. | 355/208 |
| 4,804,998 | 2/1989 | Miyawaki | 355/206 |
| 4,872,037 | 10/1989 | Kasahara et al. | 355/271 |
| 4,937,622 | 6/1990 | Makiura | 355/206 |
| 4,956,651 | 9/1990 | Emori | 346/108 |
| 5,012,281 | 4/1991 | Kusumoto et al. | 355/206 |
| 5,027,133 | 6/1991 | Weiselfish | 346/136 |
| 5,103,733 | 4/1992 | Drapatsky et al. | 101/485 |
| 5,129,047 | 7/1992 | Cha | 395/105 |
| 5,130,749 | 7/1992 | Tanada | 355/208 |
| 5,294,958 | 3/1994 | Isobe et al. | 355/208 |

*Primary Examiner*—William J. Royer
*Attorney, Agent, or Firm*—Robert E. Bushnell

[57] ABSTRACT

A method and apparatus for controlling a print engine of a page printer according to a position of printing paper are disclosed. The method includes a stand-by process for initializing each portion of the print engine to a printable state when a power source is applied and checking if a printing start key is depressed, a printing ready process for applying commands for performing a driving start of a print engine motor positioned inside the print engine, setting a printing condition set of a charge unit and a developing unit, and feeding printing paper feeding through each controller when the printing start key is depressed, and checking if a first detecting signal generated by a first sensor disposed between a pickup roller and a register roller is received, a printing process for providing a command for driving the register roller when the first detecting signal is received in order to arrange the printing paper, and sequentially applying exposing, developing and transfer commands in response to a page synchronizing signal generated when the page of printing data is newly started, and a printing release process for providing the command for returning to the stand-by process in response to a second detecting signal generated by a second sensor installed downstream of a fusing unit.

12 Claims, 4 Drawing Sheets

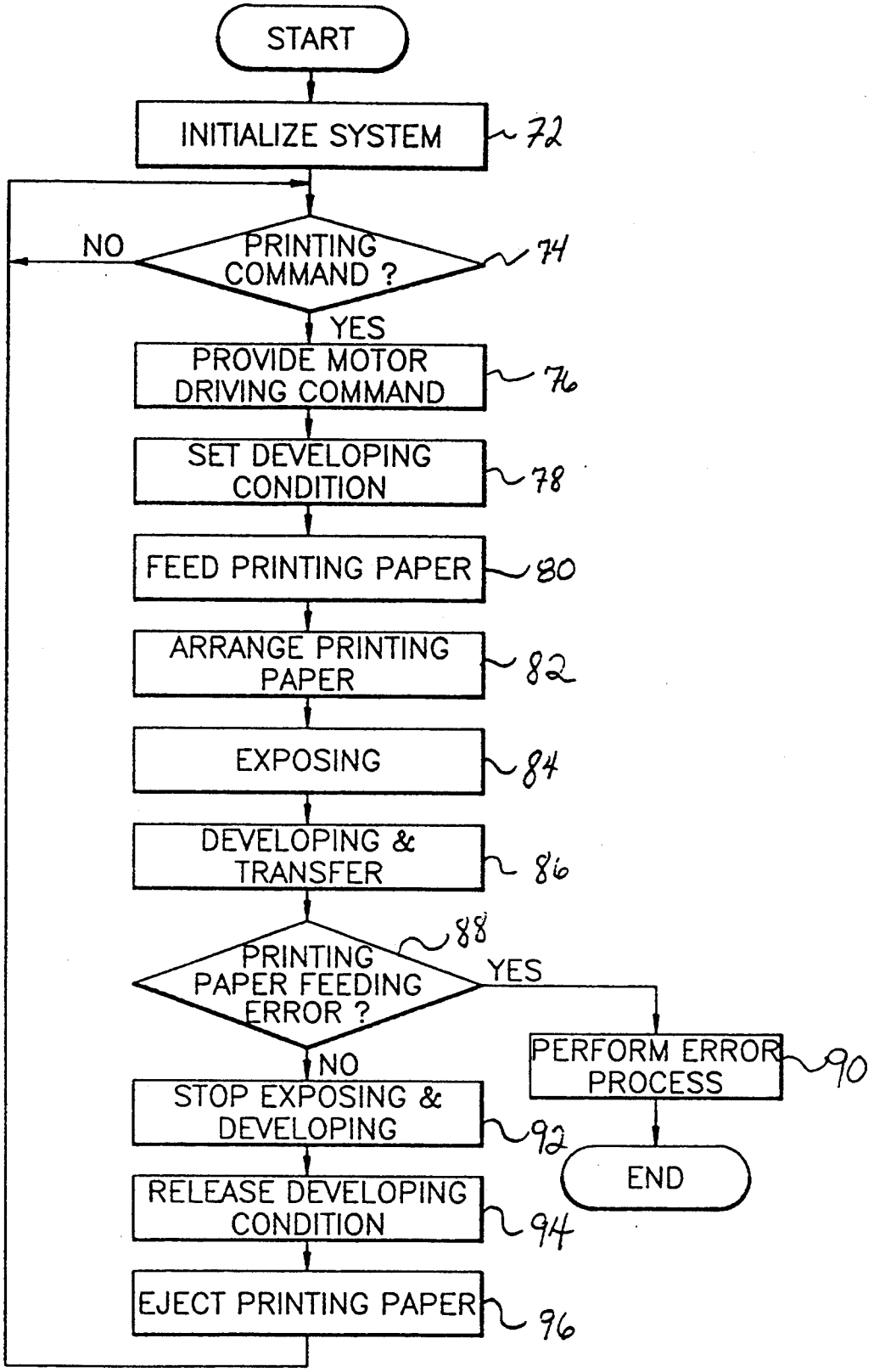
(Conventional)
FIG. 3

METHOD AND APPARATUS FOR CONTROLLING A PRINT ENGINE OF A PAGE PRINTING DEVICE

BACKGROUND OF THE INVENTION

1. Technical Field

The present invention relates to image forming devices, and more particularly, to a method and a page printing apparatus that enhances print quality and detection of paper jams by controlling a print engine of the page printing device in response to the detection and transfer of paper within the page printing device.

2. Background Art

The printing operation by which a page printing device, such as a laser printer, prints on a sheet of paper comprises a plurality of subroutines. First, the sheet of paper is drawn into the page printing device. Then, the sheet of paper is appropriately arranged and fed past a printing drum to receive toner. Thereafter, the toner is fused onto the sheet of paper, and finally, the sheet of paper is ejected from the page printing device.

Although conventional page printing devices incorporate sensors for detecting the sheet of paper within the page printing device, these sensors are not used to sequence or time the various sub-routines of the printing operation. That is, most subroutines will be performed at specified times after the printing operation begins by drawing the sheet of paper inside, regardless of whether some delay was experienced in actually grabbing the sheet of paper or whether the pickup roller is operating at a slower than predicted speed, for example. As a result, if there were a delay in grabbing the sheet of paper, for instance, toner on the printing drum will not be properly aligned when it is transferred to the sheet resulting in an improperly aligned transferred image. Therefore, the quality of the final product is undermined. Moreover, the printing drum can be damaged when the toner is not completely transferred to the paper because of the improper alignment.

Another drawback of the conventional page printing device is the failure to detect paper jams effectively. Since the various subroutines of the printing operation occur at specified times after the page printing device begins to draw-in the sheet of paper, even if the sheet of paper jams during alignment, the printing operation still goes forward. Consequently, the toner on the printing drum is again not transferred to the paper resulting in possible damage. Therefore, as is evident above, conventional techniques for operating a page printing device are inadequate and lead to damage of the page printing device.

SUMMARY OF THE INVENTION

It is an object of the present invention to provide an improved method and apparatus for controlling a print engine.

It is a further object of the present invention to provide a print engine controlling method and apparatus that overcome the aforementioned drawbacks and shortcomings.

It is another object of the present invention to provide a method and apparatus for appropriately controlling a print engine of a page printing device according to the detected position of printing paper.

It is a still further object of the present invention to provide a method and apparatus for improving printing picture quality by more accurately controlling exposing, developing and transfer operations.

In accordance with one aspect of the present invention, a method for controlling a print engine of a page printing device having a first paper sensor and a second paper sensor for sensing positions of printing paper, comprises initiating driving of a print engine motor, controlling a charging unit and a developing unit to prepare for-a printing operation, controlling a pickup roller to draw a sheet of paper into the page printing device, checking whether the first sensor disposed between the pickup roller and a register roller has detected passage of the sheet of paper, driving the register roller to align the sheet of paper in response to the first sensor detecting the passage, and sequentially applying exposing, developing and transfer commands to an exposing unit, a developing unit, and a transfer unit, respectively, in response to receipt of a page synchronizing signal from a print engine controlling circuit, the page synchronizing signal being indicative of receipt of a page of printing data from the host computer, and terminating the printing operation and entering a standby state in response to the second sensor detecting passage of the sheet of paper, the second sensor being installed downstream of the fusing unit.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 3 is a flow chart illustrating a conventional printing operation;

DETAILED DESCRIPTION OF THE PREFERRED EMBODIMENT

Figure 1:
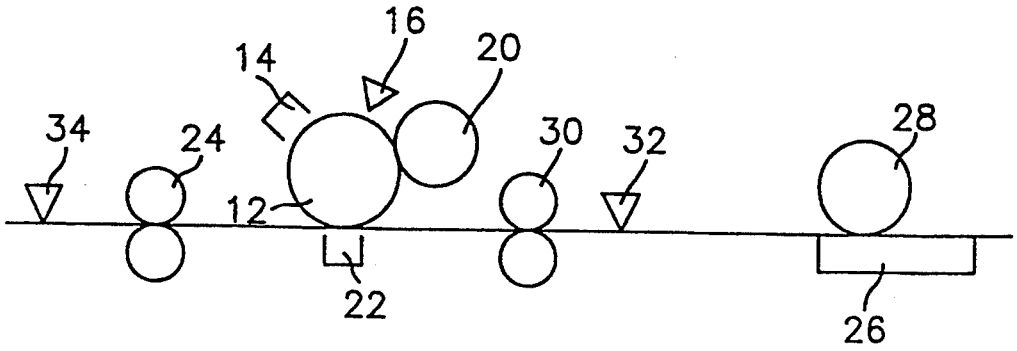
FIG. 1 is a schematic diagram illustrating the typical print engine of a page printing device.

Turning now to the figures, FIG. 1 illustrates a print engine for a page printing device. Specifically, a paper cassette 26 provides a supply of paper from which a pickup roller 28 draws a top sheet of paper. The sheet of paper is then fed to a first sensor 32 which indicates the sheet's passage by generating a first paper detecting signal. Register rollers 30, downstream of the first sensor 32, receive the sheet of paper from the pickup roller 28 then arrange and feed the sheet of paper to a transfer unit 22 and a photosensitive drum 12.

A charge unit 14 creates a uniform charge on portions of the photosensitive drum 12 rotating beneath the charge unit 14. As the photosensitive drum 12 rotates, an exposing unit 16 forms an electrostatic latent image on the uniformly charged photosensitive drum 12 by selectively exposing regions of the surface of the photosensitive drum to light in response to image data. A developing unit 20 then develops the electrostatic latent image by applying a developing material called toner. Thereafter, the toner disposed on the photosensitive drum is transferred to the sheet of paper by the transfer unit 22.

Downstream of the photosensitive drum 12 and the transfer unit 22, a fusing unit 24, comprising heated rollers, receives the sheet of paper and fuses the toner to the sheet of paper by the application of heat and pressure. Finally, a second sensor 34 is positioned downstream of the fusing unit 24 to generate a second paper detecting signal indicative of the passage of the sheet of paper.

Figure 2:
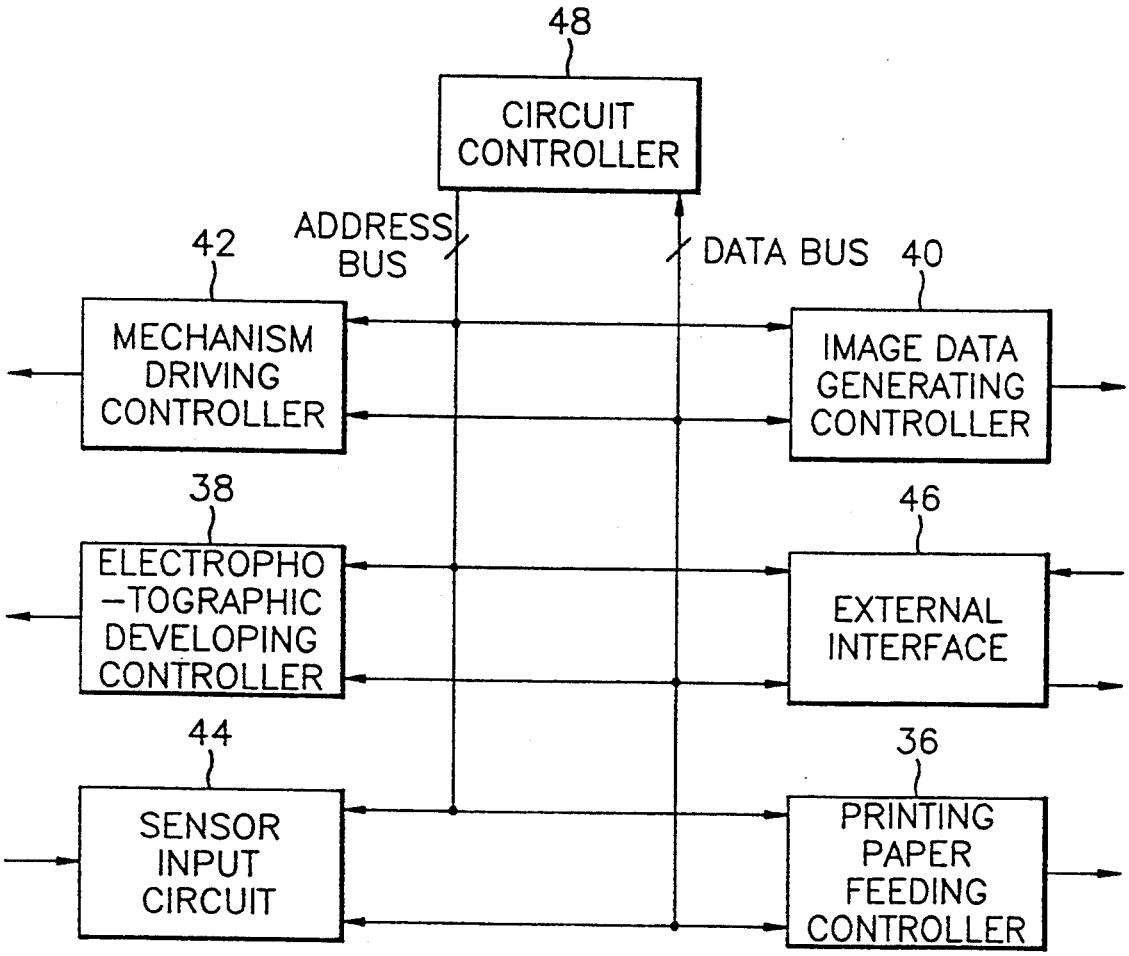
FIG. 2 is a block diagram of a print engine controlling circuit applied to the present invention.

FIG. 2 illustrates a print engine controlling circuit for controlling a print engine as that illustrated in FIG. 1. Central control is performed by a circuit controller 48 that is connected, via address and data buses, to a printing paper feeding controller 36, an electrophotographic developing controller 38, an image data generating controller 40, a mechanism driving controller 42, a sensor input circuit 44, and an external interface 46. The electrophotographic developing controller 38 controls the exposing unit 16, the developing unit 20, the transfer unit 22, and the fusing unit 24. The external interface 46 provides a connection port to a host computer, for example, to receive print data and exchange control and synchronization signals. The mechanism driving controller 42 controls a motor (not shown) that mechanically drives the print engine of FIG. 1. The paper feeding controller 36 controls the feeding of paper from the cassette 26 by the pickup roller 28. The sensor input circuit 44 receives the first paper detecting signal from the first sensor 32 and the second paper detecting signal from the second sensor 34. The image data generating controller 40 provides the print data received from the external interface 46 as image data to the exposing unit 16 so that the photosensitive drum is exposed in response to the image data.

The print engine of FIG. 1 is controlled by the print engine controlling circuit of FIG. 2 according to the central control of the circuit controller 48 which operates according to a program stored in a non-volatile memory and data stored in a random access memory. Generally, the circuit controller 48 synchronizes the operations of the various described components of the print engine controlling circuit to perform the printing operation. An exemplary description of a conventional printing operation will now be described with reference to FIG. 3.

The circuit controller 48 initiates an initialization process 72 when the page printing device is first turned on to bring the page printing device into a standby mode. In the initialization process 72, the electrophotographic developing controller 38 controls the heating of the fusing unit 24 so that its temperature is raised to a standby temperature.

When a printing command is received via the external interface 46 from the host computer, as determined in step 74, the circuit controller 48 supplies a motor driving command in step 76 to the mechanism driving controller 42 that in turn activates the motor to mechanically drive the print engine shown in FIG. 1. Additionally, the circuit controller 48 sets developing conditions in step 78 by providing a developing initialization signal to the electrophotographic developing controller 38 that in turn prepares the charging unit 14, the exposing unit 16, and the fusing unit 24 for the printing operation. For example, the electrophotographic developing controller 38 controls the heating of the fusing unit from the standby temperature to an operational temperature sufficient to fuse the toner to the sheet of paper in combination with the applied pressure of the rollers of the fusing unit 24. Also in response to the printing command, the paper feeding controller 36 controls the pickup roller 28 to feed the top sheet of paper from the cassette 26 towards a first sensor 32 in step 80 after setting developing conditions.

When the sheet of paper passes the first sensor 32, the first paper detecting signal is provided to the circuit controller 48 via the sensor input circuit 44 to confirm the sheet of paper was drawn into the page printing device.

A first predetermined time period after the page printing device begins to draw-in the sheet of paper, the circuit controller 48 generates a command for driving the register rollers 30 through the mechanism driving controller 42 so that the sheet of paper is properly arranged in step 82. A second predetermined time period after the page printing device begins to draw-in the sheet of paper, the circuit controller 48 provides an exposing command through the electrophotographic developing controller 38 to the exposing unit 16 in step 84. In response to the exposing command, the exposing unit 16 begins exposing the photosensitive drum in dependence upon the image data from the image data generating controller 40. The circuit controller 48 also applies developing and transfer commands through the electrophotographic developing controller 38 to initiate transfer of the toner from the photosensitive drum to the sheet of paper in step 86 after exposure. The toner is then fused to the sheet of paper by the fusing unit 24.

After the toner has begun to be fused, tile circuit controller 48 determines whether a second paper detecting signal from the second sensor 34 has been received. If the second paper detecting signal is normally received in step 88, the exposing and developing control is concluded in step 92, the developing conditions are released in step 94, and the sheet of paper is ejected out of the printing device in subsequent step 96. If the paper detecting signal is not normally received, however, an error process is performed in step 90.

The above-described conventional printing operation suffers from a number of drawbacks or shortcomings. In the conventional printing operation, the various printing steps are performed sequentially on the basis of predicted times to perform each step. That is, the first predetermined time period after the paper feeding step 80, the register rollers are driven in step 82. Similarly, the second predetermined time after the paper feeding step 80, the circuit controller 48 provides the exposing command in step 84. As a result of this sequential operation, if some slippage between the pickup roller 28 and the sheet of paper occurs or if the pickup roller turns more slowly than expected, the printed image will not be properly aligned on the sheet of paper. Moreover, if the sheet of paper jams at the register rollers 30, the printing operation will not be disabled until the second paper detecting signal is determined to not be normally received in step 88. As a result of the paper jam at the register roller or the misalignment, the toner will be transferred to the photosensitive drum 12 but not fully transferred to the sheet of paper which can damage the drum 12. Therefore, the conventional printing operation can result in at least misaligned images on the printed sheet of paper and, at worst, damage to the components of the conventional printing device.

The solution to the previously described problems arising during the conventional printing operation lies in more fully utilizing the sensory feedback from the first and second sensors 32, 34. Rather than perform each step on the basis of programmed predicted times for performing previous steps, the sequencing of the steps should be performed on the basis of the sensor feedback from the first and second sensors 32, 34.

Figure 4:
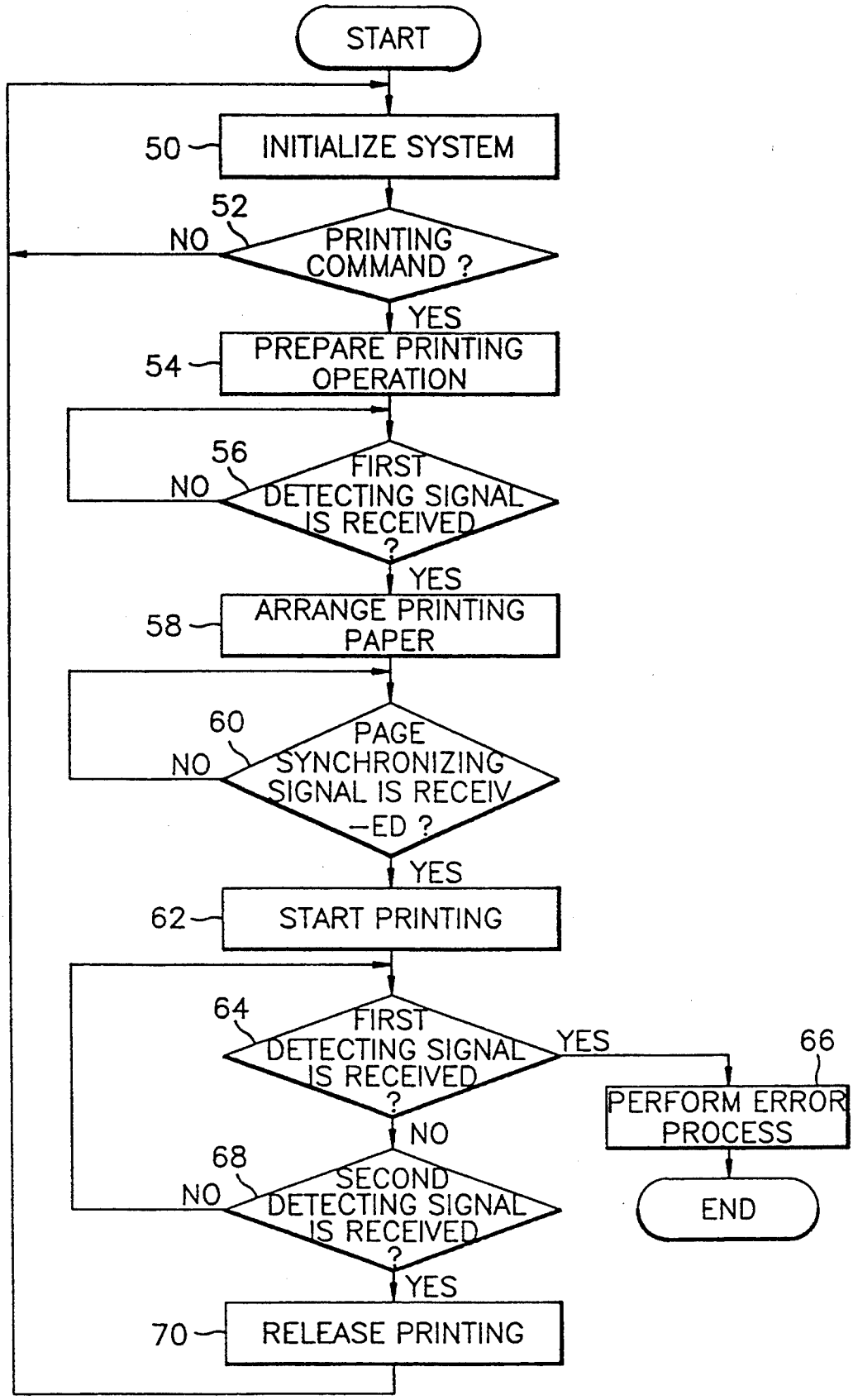
FIG. 4 is a flow chart illustrating a printing operation according to an embodiment of the present invention.

FIG. 4 illustrates a printing operation designed according to the principles of the present invention that overcomes the drawbacks associated with the conventional printing operation. In step 50, the circuit controller 48 provides the initialization command to each control block indicated in FIG. 2 so that a print engine as that shown in FIG. 1 is brought into a standby mode similar to that described in reference to step 72 of the conventional printing operation. Included in the initialization is a command to the electrophotographic developing controller 38 to heat the fusing unit 24 to the standby temperature. Then, at step 52, in response to receipt of a print command from the host computer via the external interface 46, program control proceeds to step 54 to prepare for the printing operation. Preparation for the printing operation includes generating developing initialization signals for initiating a driving state of the motor and confirming that the charge unit 14 and the developing unit 20 satisfy predefined conditions necessary for the printing operation. Also as part of step 52, the paper feeding controller controls the pickup roller 28 to draw-in the top sheet of paper from the paper cassette 26 into the paper printing device.

After preparing for the printing operation including drawing-in the sheet of paper, the circuit controller 48 waits until a first detecting signal has been generated by the first sensor 32, at step 56. The first detecting signal indicates that the sheet of paper is underneath the first sensor 32. Only after the first detecting signal has been received does the circuit controller 48 provide the command for driving the register roller 30 through the mechanism driving controller 42 so that the sheet of paper received from the pickup roller 28 will be properly arranged, at step 58. At subsequent step 60, the circuit controller 48 determines whether a page synchronizing signal has been received. The page synchronizing signal indicates that a page of printing data is being received from the host computer. Once the page synchronizing signal is received, actual printing is initiated in step 62 which includes exposure of the photosensitive drum 12 by the exposing unit 16 under control of the image data generating controller 40 and development of the latent photostatic image by the developing unit 20 under control of the electrophotographic developing controller 38.

In step 64, following step 62, the circuit controller 48 again checks whether the first detecting signal is being received, i.e., whether the sheet of paper is still underneath the first sensor. If the first detecting signal is still received, an error process is performed at step 66. The error process is performed because the receipt the first detecting signal at step 64 indicates that the sheet of paper is still under the first sensor 32 meaning that the sheet of paper is most likely jammed at the register roller 30. The error process may be implemented by generating an error sound to an operator and/or displaying an error message on a display unit of the paging printing device and terminating any printing operation.

If the first detecting signal is not received at step 64 indicating that the sheet of paper had been fed correctly, receipt of the second detecting signal at step 68 is determined. Here, if the second detecting signal is received, the printing operation is released, at step 70, by stopping the exposing-developing control, releasing the developing condition, and ejecting the printing paper at step 70. Finally, after step 70 program control returns to step 50.

Figure 5:
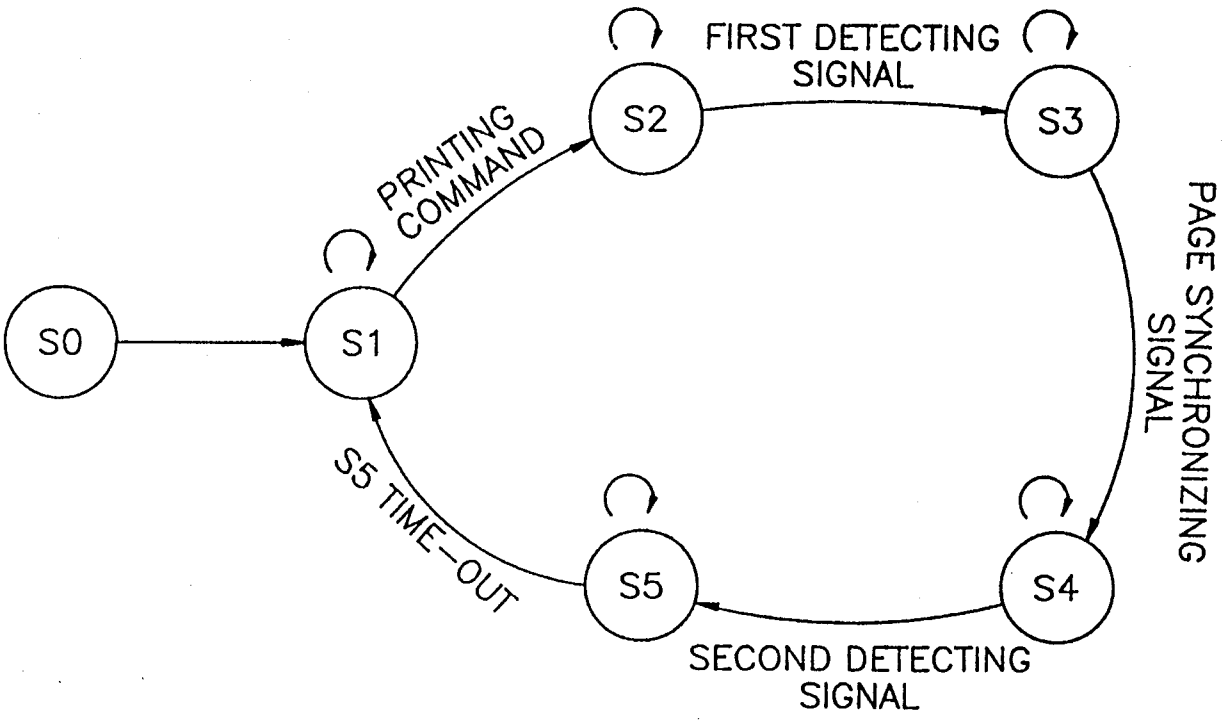
FIG. 5 is a diagram illustrating the state space diagram of the inventive printing operation.

FIG. 5 is a state space diagram of the inventive printing operation in which each transition operation is ultimately controlled by the circuit controller 48. In more detail, the transition operation from a system initializing state SO to a stand-by state S1 is achieved by initializing each portion of the print engine to the standby mode when a power source is first applied and checking whether a printing start key is depressed or not. The steps 50 and 52 of FIG. 4 correspond to the system initializing state SO and the stand-by state S1.

The transition operation from the stand-by state SI to a printing preparation state S2 is executed by applying the commands for starting the driving state of the print engine motor, setting up a printing condition of the charge unit 14 and the developing unit 20, and checking whether the first paper detecting signal is generated by the first sensor 32 disposed between the pickup roller 28 and the register roller 30. Steps 54 and 56 of FIG. 4 are equivalent to the print preparation state S2.

Transition from the printing preparation state S2 to a paper arranging state S3 is implemented by applying the command for driving the register rollers 30 through the mechanism driving controller 42 only after the first detecting signal is generated. The paper arranging state S3 corresponds to step 58.

The transition operation from tile paper arranging state S3 to a printing state S4 is achieved by sequentially supplying exposing, developing and transfer commands through a corresponding controller when the page synchronizing signal is received from the print engine control circuit. The printing state S4 is equivalent to the steps 60 and 62 of FIG. 4. The transition operation from the printing state S4 to a printing release state S5 and further back to the stand-by state S1 is executed by providing the command for transiting to the stand-by state through each controller in response to the second detecting signal generated by the second sensor 34. The printing release state S5 corresponds to steps 64, 66, 68, and 70 of FIG. 4.

In the preferred embodiment of tile present invention, the first and second sensors are photocoupler devices and the routines shown in FIG. 4 arc programmed in "C" computer language in the nonvolatile memory of the circuit controller.

As described above, the printing process can be accurately controlled in response to the position of the printing paper resulting in enhanced printing quality and durability of the photosensitive drum.

While there is shown and described the preferred embodiment of the present invention, it will be understood by those skilled in the art that foregoing and other changes in form and details may be made without departing from the spirit and scope of the present invention.

What is claimed is:

1. A method for invoking an error process in a page printing device, said page printing device comprising: a pickup roller for drawing a sheet of paper from a paper cassette into said page printing device, a register roller for arranging said sheet of paper, a first paper sensor positioned between said register roller and said pickup roller for detecting passage of said sheet of paper, a photosensitive drum for receiving said sheet of paper from said register roller and for transferring toner onto said sheet of paper, means for fusing said toner on said sheet of paper, and a second paper sensor positioned downstream of said fusing means for detecting passage of said sheet of paper, said method comprising:

enabling a printing process including transferring toner from said photosensitive drum onto said sheet of paper;

determining whether said sheet of paper has completely passed said first sensor and determining whether said sheet of paper has reached said second sensor;

invoking said error process if said sheet of paper has not completely passed said first sensor; and performing a printing release process for terminating said printing process if said sheet of paper has reached said second sensor.

2. The method as claimed in claim 1, further comprised of said step of invoking said error process comprising the sub-step of generating an audible sound indicative of a printing error when said sheet of paper has not completely passed said first sensor.

3. The method as claimed in claim 2, further comprised of said step of invoking said error process comprising the sub-step of providing a variable visual display indicative of a printing error when said sheet of paper has not completely passed said first sensor.

4. The method as claimed in claim 1, further comprised of said step of invoking said error process comprising the sub-step of providing a variable visual display indicative of a printing error when said sheet of paper has not completely passed said first sensor.

5. A method for controlling a print engine of a page printer having first and second sensors for sensing positions of printing paper, said method comprising the steps of:

entering a stand-by state by initializing each portion of said print engine to a printable state when a power source is applied and checking if a printing start key is depressed;

applying commands for driving a print engine motor positioned inside said print engine, setting a printing condition of a charge unit and a developing unit, feeding printing paper through a paper path when said printing start key is depressed, and checking whether a first detecting signal generated by said first sensor disposed between a pickup roller and a register roller is received;

providing a command for driving said register roller when said first detecting signal is received in order to arrange said printing paper, and sequentially generating exposing, developing, and transfer commands in response to a page synchronizing signal generated when a page of printing data is newly received;

informing a user of an occurrence of a printing error whether said first detecting signal is still being received after said exposing, developing and transfer commands are generated; and returning to said stand-by state in response to a second detecting signal generated by said second sensor installed downstream of a fusing unit.

6. The method as claimed in claim 5, wherein said informing step further comprises the sub-step of:

generating an audible sound indicative of said printing error when said printing error has occurred.

7. The method as claimed in claim 5, further comprised of said informing step comprising the sub-step of providing a variable visual display indicative of said printing error when said printing error has occurred.

8. An apparatus for controlling a print engine of a page printer, comprising:

first and second sensing means for sensing a position of printing paper;

initializing means for initializing each portion of said print engine to a printable state when a power source is applied and checking whether a printing start key is depressed;

printing ready means for applying commands for driving a print engine motor positioned inside said print engine, establishing a printing condition of a charge unit and a developing unit and feeding printing paper through each controller when said printing start key is depressed, and checking whether a first detecting signal generated by said first sensing means disposed between a pickup roller and a register roller is received;

printing means for providing a command for driving said register roller when said first detecting signal is received in order to arrange said printing paper, and sequentially generating exposing, developing and transfer commands in response to generation of a page synchronizing signal generated when a page of printing data is newly received;

means for informing a user of a printing error when said first detecting signal is still being generated by said first sensing means after said exposing, developing and transfer commands have been generated; and printing release means for providing a command for initializing each portion of said print engine in response to a second detecting signal generated by said second sensing means installed downstream of a fusing unit.

9. The apparatus as claimed in claim 8, further comprised of said printing error being indicated to the user by an audible tone.

10. The apparatus as claimed in claim 8, further comprised of said printing error being indicated to the user via a variable visual display.

11. An apparatus for controlling a print engine of a page printing device, comprising:

a pickup roller for drawing a sheet of paper from a paper cassette into said page printing device;

a register roller for arranging said sheet of paper, a first paper sensor positioned between said register roller and said pickup roller for detecting passage of said sheet of paper;

a photosensitive drum for receiving said sheet of paper from said register roller, and for transferring toner onto said sheet of paper;

means for fusing said toner on said sheet of paper;

a second paper sensor positioned downstream of said fusing means for detecting passage of said sheet of paper; and control circuit means for enabling a printing process including transferring toner from said photosensitive drum onto said sheet of paper, determining whether said sheet of paper has completely passed said first sensor and determining whether said sheet of paper has reached said second sensor, invoking an error process indicative of a paper jam whether said sheet of paper has not completely passed said first sensor after said printing process has been initiated; and said control circuit means performing a printing release process for terminating said printing process if said sheet of paper has reached said second sensor.

12. The apparatus as claimed in claim 11, further comprised of said control circuit means enabling an audible tone during said error process to indicate the paper jam.

* * * * *